US005641734A

United States Patent [19]

Naegely

[11] Patent Number: 5,641,734

[45] Date of Patent: Jun. 24, 1997

[54] BIODEGRADABLE CHAIN BAR LUBRICANT COMPOSITION FOR CHAIN SAWS

[75] Inventor: Paul C. Naegely, Mentor, Ohio

[73] Assignee: The Lubrizol Corporation, Wickliffe, Ohio

[21] Appl. No.: 504,796

[22] Filed: Jul. 20, 1995

Related U.S. Application Data

[63] Continuation of Ser. No. 148,739, Nov. 5, 1993, abandoned, which is a continuation-in-part of Ser. No. 785,639, Oct. 31, 1991, abandoned.

[51] Int. Cl.[6] ..... C10M 161/00

[52] U.S. Cl. ..... 508/233; 508/468; 508/470; 508/476; 508/487

[58] Field of Search ..... 252/51.5 A, 565, 252/54.6, 56 D, 56 R; 508/233, 468, 470, 476, 487

[56] References Cited

U.S. PATENT DOCUMENTS

| | | | |
|---|---|---|---|
| 1,191,328 | 7/1916 | Mackle . | |
| 1,559,592 | 11/1925 | Webster . | |
| 1,934,100 | 11/1933 | Stiepel | 87/9 |
| 2,160,572 | 5/1939 | Eichwald | 87/9 |
| 2,246,549 | 6/1941 | Spangler | 252/56 |
| 2,291,384 | 7/1942 | Flaxman | 252/37 |
| 2,866,729 | 12/1958 | Zimpel | 148/29 |
| 3,170,539 | 2/1965 | Snay et al. | 184/15 |
| 3,215,707 | 11/1965 | Rense | 260/326.3 |
| 3,219,666 | 11/1965 | Norman et al. | 260/268 |
| 3,231,587 | 1/1966 | Rense | 260/346.8 |
| 3,507,792 | 4/1970 | Zuraw | 252/49.5 |
| 3,702,301 | 11/1972 | Baldwin | 252/56 |
| 3,791,975 | 2/1974 | Halkins | 252/49.5 |
| 3,840,462 | 10/1974 | Getretschlager | 252/34.7 |
| 3,860,521 | 1/1975 | Aepli et al. | 252/34.7 |
| 3,933,659 | 1/1976 | Lyle et al. | 252/32.7 |
| 4,115,282 | 9/1978 | Dieter | 252/18 |
| 4,149,982 | 4/1979 | Lee et al. | 252/48.6 |
| 4,563,294 | 1/1986 | Geymayer et al. | 252/49.3 |
| 4,663,061 | 5/1987 | Kuwamoto et al. | 252/32.5 |
| 4,693,839 | 9/1987 | Kuwamoto et al. | 252/51.5 A |
| 4,740,324 | 4/1988 | Schur | 252/56 |
| 4,783,274 | 11/1988 | Jokinen et al. | 252/32.7 |
| 4,801,390 | 1/1989 | Robson | 252/51.5 A |
| 4,803,003 | 2/1989 | Chung | 252/56 R |
| 4,857,220 | 8/1989 | Hashimoto | 252/56 |
| 4,929,372 | 5/1990 | Akanuma et al. | 252/29 |
| 4,938,881 | 7/1990 | Ripple et al. | 252/32.7 |
| 4,948,521 | 8/1990 | Stewart et al. | 252/28 |
| 4,957,651 | 9/1990 | Schwind | 252/56 R |
| 5,160,446 | 11/1992 | Nalesnik et al. | 252/51.5 A |

OTHER PUBLICATIONS

Hawley's Condensed Chemical Dictionary, Eleventh Edition, Van Nostrand Reinhold, 1981 (no month).

"Lubricant Additives", C.V. Smalheer & R. Kennedy Smith, The Lezius–Hiles Co., 1967 (no month).

*Primary Examiner*—Jacqueline V. Howard

*Attorney, Agent, or Firm*—James L. Cordek; Frederick D. Hunter; Joseph P. Fischer

[57] ABSTRACT

A lubricant composition is described which is useful as a chain bar lubricant for chain saws. The composition comprises (A) at least one triglyceride wherein the ratio of the oleic acid moiety:linoleic acid moiety is from about 2 up to about 90, (B) at least one viscosity modifying additive, and (C) at least one tackifier.

Optionally, the composition may also contain (D) at least one pour point depressant and (E) at least one antiwear agent.

59 Claims, No Drawings

BIODEGRADABLE CHAIN BAR LUBRICANT COMPOSITION FOR CHAIN SAWS

This is a continuation of application Ser. No. 08/148,739 filed on Nov. 5, 1993 which is a continuation-in-part of Ser. No. 07/785,639 filed on Oct. 31, 1991 both now abandoned.

FIELD OF THE INVENTION

This invention relates to a biodegradable chain bar lubricant composition and more particularly to a chain bar lubricant containing a triglyceride.

BACKGROUND OF THE INVENTION

A typical chain bar lubricant composition has mineral oil as its base fluid. During operation of a chain saw much of the lubricant from the chain bar is deposited on the ground. This composition is not biodegradable. As a result, typical chain bar lubricant compositions remain in the environment after use for a great period of time causing considerable pollution particularly of the waterbed. As is generally known, one liter of such compositions is sufficient to render about 1 million liters of water unfit for human consumption.

U.S. Pat. No. 3,860,521 (Aepli et al., Jan. 14, 1975) provides an aqueous lubricating concentrate for lubricating continuously moving conveyor systems wherein said concentrate contains a fatty acid soap and a surfactant, wherein the improvement comprises the addition to said composition of monostearyl acid phosphate in an amount from about 0.15 to about 1.75 weight percent of the concentrate. The concentrate when diluted with water is then ready for use as a lubricating composition.

U.S. Pat. No. 3,170,539 (Snay et al., Feb. 23, 1965) relates to lubricating and more specifically to a method of and means for automatic lubrication of mechanism such as dairy conveyors with a lubricant such as a soap, water and water softening additive mixture.

U.S. Pat. No. 4,740,324 (Schur, Apr. 26, 1988) discloses biodegradable tenacious compositions comprising a biodegradable lubricating oil and a biodegradable resinous component selected from the group consisting of colophonium-containing resins, colophonium and mixtures thereof. These compositions have utility as lubricants or as mold release agents.

U.S. Pat. No. 2,866,729 (Zimpel, Dec. 30, 1958) relates to a quenching oil composition for use in the metallurgical industries and to the method of quenching metals therewith. The quenching oil composition comprises a mineral oil base containing a critical amount within the range of from about 1.75% to about 3.0% by weight and preferably between 2.0% and 3.0% of an artificial resin prepared by polymerizing cycloalkene hydrocarbons or lower polymers thereof with linolenic acid oils and their derivatives.

SUMMARY OF THE INVENTION

A biodegradable chain bar lubricant is disclosed which is comprised of (A) at least one triglyceride;

(B) at least one viscosity modifying additive; and (C) at least one tackifier.

The biodegradable chain bar lubricant may also include (D) at least one pour point depressant and (E) at least one antiwear agent.

DETAILED DESCRIPTION OF THE INVENTION

Generally this invention provides biodegradability to a chain bar lubricant composition. The essential components are: (A) at least one triglyceride; (B) at least one viscosity modifying additive; and (C) at least one tackifier. As additional components, (D) at least one pour point depressant and (E) at least one antiwear agent may also be included. The term "biodegradable" describes a property which allows a compound to be broken down into smaller innocuous components which generally leave no long lived toxic residues and thus no contamination of the environment. The industry wide biodegradability test employed for the instant invention is the CEC L33-T82.

(A) The Triglyceride

The triglycerides of this invention are either a synthetic or naturally occurring triglyceride. Preferred is the naturally occurring triglyceride. The triglycerides are of the general formula

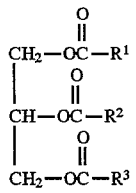

and are esters having at least one straight chain fatty acid moiety and a glycerol moiety wherein the fatty acid moiety contains $R^1$, $R^2$ and $R^3$ which are saturated or unsaturated aliphatic hydrocarbon groups containing from about 8 to about 22 carbon atoms, preferably from about 12 to 22 carbon atoms.

Naturally occurring triglycerides having utility in this invention are exemplified by vegetable oils that are genetically modified such that they contain a higher than normal oleic acid content. That is, the $R^1$, $R^2$ and $R^3$ groups are heptadecenyl groups and the $R^1COO^-$, $R^2COO^-$ and $R^3COO^-$ that are attached to the 1,2,3,-propanetriyl groups $-CH_2CHCH_2-$ are the residue of an oleic acid molecule. Generally the fatty acid moieties are such that the triglyceride has monounsaturated character of at least 60 percent, preferably 80 percent. Normal sunflower oil has an oleic acid content of 20–40 percent. By genetically modifying the seeds of sunflowers, a sunflower oil can be obtained wherein the oleic content is from about 60 percent up to about 90 percent. U.S. Pat. Nos. 4,627,192 and 4,743,402 are herein incorporated by reference for their disclosures directed to the preparation of high oleic sunflower oil.

For example, a triglyceride comprised exclusively of an oleic acid moiety has an oleic acid content of 100 percent and consequently a monounsaturated content of 100 percent. When the triglyceride is made up of acid moieties that are 70 percent oleic acid, 10 percent stearic acid, 5 percent palmitic acid, 7 percent linoleic acid and 8 percent hexadecenoic acid, the monounsaturated content is 78 percent. The preferred triglyceride oils are genetically modified high oleic (at least 60 percent) acid triglyceride oils. Typical genetically modified high oleic vegetable oils employed within the instant invention are high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein. A preferred high oleic vegetable oil is high oleic sunflower oil obtained from Helianthus sp. This product is available from SVO Enterprises, Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from Brassica campestris or Brassica napus, also available from SVO Enterprises as RS® high oleic rapeseed oil. RS 80 signifies a rapeseed oil wherein the acid moieties comprise 80 percent oleic acid.

It is to be noted the olive oil is excluded as a vegetable oil in this invention. The oleic acid content of olive oil typically ranges from 65–85 percent. This content, however, is not achieved through genetic modification, but rather is naturally occurring.

It is further to be noted that genetically modified vegetable oils have high oleic acid contents at the expense of the di- and tri- unsaturated acids. A normal sunflower oil has from 20–40 percent oleic acid moieties and from 50–70 percent linoleic acid moieties. This gives a 90 percent content of mono- and di-unsaturated acid moieties (20+70 or 40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

(B) The Viscosity Modifying Additive

The viscosity modifying composition functions to decrease the slope of the viscosity temperature relationship so that the oil is more viscous at higher temperature than it would be without the viscosity improver while at the same time not making the oil too thick at lower temperatures. In one aspect, Component (B), as (B-1) contemplates the provision of a nitrogen-containing ester of a carboxyl-containing interpolymer, said interpolymer having a reduced specific viscosity of from about 0.05 to about 2, said ester being substantially free of titratable acidity and being characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polymnino group derived from a polyamino compound having one primary or secondary amino group, wherein the molar ratio of (A):(B):(C) is (60–90): (10–30):(2–15)

An essential element of the nitrogen-containing ester is that the ester is a mixed ester, i.e., one in which there is the combined presence of both a high molecular weight ester group and a low molecular weight ester group, particularly in the ratio as stated above. Such combined presence is critical to the viscosity properties of the mixed ester, both from the standpoint of its viscosity modifying characteristics and from the standpoint of its thickening effect upon lubricating compositions in which it is used as an additive.

In reference to the size of the ester groups, it is pointed out that an ester radical is represented by the formula

-C(O)(OR)

and that the number of carbon atoms in an ester radical is the combined total of the carbon atoms of the carbonyl group and the carbon atoms of the ester group i.e., the (OR) group.

Another essential element of Component (B-1) is the presence of a polyamino group derived from a particular polyamino compound, i.e., one in which there is one primary or secondary amino group and at least one mono-functional amino group. Such polyamino groups, when present in the nitrogen-containing esters of (B-1) in the proportion stated above enhances the dispersability of such esters in lubricant compositions and additive concentrates for lubricant compositions.

Still another essential element of Component (B-1) is the extent of esterification in relation to the extent of neutralization of the unesterified carboxyl groups of the carboxyl-containing interpolymer through the conversion thereof to polyamino-containing groups. For convenience, the relative proportions of the high molecular weight ester group to the low molecular weight ester group and to the polyamino group are expressed in terms of molar ratios of (60–90):(10–30) :(2–15), respectively. The preferred ratio is (70–80) :(15–25):5. It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In a particularly advantageous embodiment of the invention such linkage is imide or predominantly imide.

Still another important element of Component (B-1) is the molecular weight of the carboxyl-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry*, (1953 Edition) pages 308 et seq.

While interpolymers having reduced specific viscosity of from about 0.05 to about 2 are contemplated in Component (B-1), the preferred interpolymers are those having a reduced specific viscosity of from about 0.3 to about 1. In most instances, interpolymers having a reduced specific viscosity of from about 0.5 to about 1 are particularly preferred.

From the standpoint of utility, as well as for commercial and economical reasons, nitrogen-containing esters in which the high molecular weight ester group has from 8 to 24 aliphatic carbon atoms, the low molecular weight ester group has from 3 to 5 carbon atoms, and the carbonyl polyamino group is derived from a primary-aminoalkyl-substituted tertiary amine, particularly heterocyclic amines, are preferred. Specific examples of the high molecular weight carboxylic ester group, i.e., the (OR) group of the ester radical (i.e., -(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, iso-butyloxy, n-pentyloxy, neo-pentyloxy, n-hexyloxy, cyclohexyloxy, xyxlopentyloxy, 2-methyl-butyl- 1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonmnides, phosphoramides, phenolthiaznes, amidines, etc. Examples of such polymnino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridyl-ethylamine, bis-(dimethylamino)propyl- mine, bis-(diethylamino)ethylamine, N,N-dimethyl-p- phenylene diamine, piperidyl-ethylamine, 1-aminoethyl pyrazole, 1-(methylamino)pyrazoline, 1-methyl-4-amino- octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1-aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxyl-containing interpolymers include principally interpolymers of alpha, beta-unsaturated acids or anhydrides such as maleic anhydride or itaconic anhydride with olefins (aromatic or aliphatic) such as ethylene, propylene, styrene, or isobutene. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of Component (B-1) are most conveniently prepared by first esterifying the carboxyl-containing interpolymer with a relatively high molecular weight alcohol and a relatively low molecular weight alcohol to convert at least about 50% and no more than about 98% of the carboxyl radicals of the interpolymer to ester radicals and then neutralizing the remaining carboxyl radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxyl radicals of the interpolymer to ester radicals. In a preferred embodiment, the degree of esterification ranges from about 75% to about 95%.

The esterification can be accomplished simply be heating the carboxyl-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well know in the art.

A particularly desirable method of effecting esterification involves first reacting the carboxyl-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxyl-containing interpolymer is first esterified with the relatively high molecular weight alcohol so as to convert from about 50% to about 75% of the carboxyl radicals to ester radicals and then with the relatively low molecular weight alcohol to achieve the finally desired degree of esterification results in products which have unusually beneficial viscosity properties.

The esterified interpolymer is then treated with a polyamino compound in an amount so as to neutralize substantially all of the unesterified carboxyl radicals of the interpolymer. The neutralization is preferably carded out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the polyamino compound is often desirable, so as to insure substantial completion of neutralization, i.e., no more than about 2% of the carboxyl radicals initially present in the interpolymer remained unneutralized.

The following examples are illustrative of the preparation of Component (B-1) of the present invention. Unless otherwise indicated all parts and percentages are by weight.

EXAMPLE (B-1)-1

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts), The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxyl radicals of the polymer has been esterified. To the esterified interpolymer, there is then added aminopropyl morpholine (3.71 parts; 10% in excess of the stoichiometric amount required to neutralize the remaining free carboxyl radicals) and the resulting mixture is heated to 150°–160° C./10 mm. Hg to distill off toluene and any other volatile components. The stripped product is mixed with an additional amount of mineral oil (12 parts) filtered. The filtrate is a mineral oil solution of the nitrogencontaining mixed ester having a nitrogen content of 0.16–0.17%.

EXAMPLE (B-1)-2

The procedure of Example (B-1)-1 is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (B-1)-3

The procedure of Example (B-1)-1 is followed except that the esterification is carried out by first esterifying the styrene-maleic interpolymer with the commercial alcohol having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carbonyl radicals of the interpolymer have been converted to ester radicals.

EXAMPLE (B-1)-4

The procedure of Example (B-1)-1 is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°–106° C. (The resulting interpolymer has a reduced specific viscosity of 0.45).

EXAMPLE (B-1)-5

The procedure of Example (B-1)-1 is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°–92° C. (The resulting interpolymer has a reduced specific viscosity of 0.91).

EXAMPLE (B-1)-6

The procedure of Example (B-1)-1 is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°–82° C. for about 5 hours. (The resulting interpolymer has a reduced specific viscosity of 1.24.)

EXAMPLE (B-1)-7

The procedure of Example (B-1)-1 is followed except that acetone (1340 parts) is used in place of benzene as the polymerization solvent and that azobisisobutyronitrile (0.3 part) is used in place of benzoyl peroxide as a polymerization catalyst.

EXAMPLE (B-1)-8

An interpolymer (0.86 carboxyl equivalent) of styrene and maleic anhydride (prepared from an equal molar mixture of styrene and maleic anhydride and having a reduced specific viscosity of 0.69) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are convened to ester radicals. The partially esterified interpolymer is then further esterified with an-butyl alcohol (0.31 mole) until 95% of the carboxyl radicals of the interpolymer are convened to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). The resulting product is mixed with mineral oil so as to form an oil solution containing 34% of the polymeric product.

Examples (B-1)-1 through (B-1)-8 are prepared using mineral oil as the diluent. All of the mineral oil or a portion thereof may be replaced with a naturally occurring triglyceride. The preferred triglyceride is rapeseed oil or the high oleic sunflower oil.

EXAMPLE (B-1)-9

Charged to a 12 liter 4 neck flask is 3621 parts of the interpolymer of Example (B-1)-8 as a toluene slurry. The percent toluene is about 76 percent. Stirring is begun and 933 parts (4.3 equivalents) Alfol 1218 alcohol and 1370 parts xylene are added. The contents are heated and toluene is removed by distillation. Additional xylene is added in increments of 500, 500, 300 and 300 parts while continuing to remove toluene, the object being to replace the lower boiling toluene with the higher boiling xylene. The removal of solvent is stopped when the temperature of 140° C. is reached. The flask is then fitted with an addition funnel and the condenser is set to reflux. At 140° C., 23.6 parts (0.17 equivalents) methanesulfonic acid in 432 parts (3 equivalents) Alfol 810 alcohol is added in about 20 minutes. The contents are stirred overnight at reflux while collecting water in a Dean Stark trap. Then added is 185 parts (2.5 equivalents) of n-butanol containing therein 3.0 parts (0.02 equivalents) of methanesulfonic acid. This addition occurs over a 60 minute time period. The contents are maintained at reflux for 8 hours and then an additional 60 parts (0.8 equivalents) n-butanol is added and the contents are permitted to reflux overnight. At 142° C. is added 49.5 parts (0.34 equivalents) aminopropylmorpholine in 60 minutes. After a 2 hour reflux 13.6 parts (equivalents) 50% aqueous sodium hydroxide is added over 60 minutes and after an additional 60 minutes of stirring there is added 17 parts of an alkylated phenol.

To a 1 liter flask is added 495 parts of the above esterified product. The contents are heated to 140° C. and 337 parts Sunyl® 80 is added. Solvent is removed at 155° C. with nitrogen blowing at 1 cubic foot per hour. The final stripping conditions are 155° C. and 20 mm Hg. At 100° C. the contents are filtered using diatomaceous earth.

In another aspect Component (B) is at least one hydrocarbon-soluble acrylate polymer (Component (B-2) of the formula

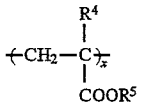

wherein $R^4$ is a lower alkyl group containing from 1 to about 4 carbon atoms, $R^5$ is a mixture of alkyl groups containing from about 4 to about 20 carbon atoms, and x is an integer providing a weight average molecular weight (Mw) to the acrylate polymer of about 5000 to about 1,000,000.

Preferably $R^4$ is a methyl or ethyl group and more preferably, a methyl group. $R^5$ is primarily a mixture of alkyl groups containing from 4 to about 18 carbon atoms. In one embodiment, the weight average molecular weight of the acrylate polymer is from about 100,000 to about 1,000,000 and in other embodiments, the molecular weight of the polymer may be from 100,000 to about 700,000 and 300,000 to about 700,000.

Specific examples of the alkyl groups $R^5$ which may be included in the polymers of the present invention include, for example, n-butyl, octyl, decyl, dodecyl, tridecyl, octadecyl, hexadecyl, octadecyl. The mixture of alkyl groups can be varied so long as the resulting polymer is hydrocarbon-soluble.

An example of a commercially available methacrylate ester polymer which has been found to be useful in the present invention is sold under the tradename of "Acryloid 702" by Rohm and Haas, wherein $R^5$ is predominantly a mixture of n-butyl, tridecyl, and octadecyl groups. The weight average molecular weight (Mw) of the polymer is about 404,000 and the number average molecular weight (Mn) is about 118,000. Another commercially available methacrylate polymer useful in the present invention is available under the tradename of "Acryloid 954" by Rohm and Haas, wherein $R^5$ is predominantly a mixture of n-butyl, decyl, tridecyl, octadecyl, and tetradecyl groups. The weight average molecular weight of Acryloid 954 is found to be about 440,000 and the number average molecular weight is about 111,000. Each of these commercially available methacrylate polymers is sold in the form of a concentrate of about 40% by weight of the polymer in a light-colored mineral lubricating oil base. In the following specific examples, when the polymer is identified by the tradename, the amount of material added is intended to represent an amount of the commercially available Acryloid material including the oil.

(C) The Tackifier

The tackifier provides adhesiveness and anti-drip characteristics to the chain bar lubricant.

The tackifier is a substituted succinic acylating agent which can be characterized by the presence within its structure of two groups or moieties. The first group or moiety is referred to herein, for convenience, as the "substituent group(s)" and is derived from a polyalkene. The polyalkene from which the substituted groups are derived is characterized by a Mn (number average molecular weight) value of from 1300 to about 5000 and a Mw/Mn value of about 1.5 to about 4.

The second group or moiety is referred to herein as the "succinic group(s)". The succinic groups are those groups characterized by the structure

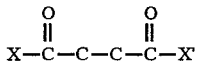

(I)

wherein X and X are the same or different provided at least one of X and X' is such that the substituted succinic acylating agent can function as carboxylic acylating agents. That is, at least one of X and X' must be such that the substituted acylating agent can esterify alcohols, form amides or amine salts with ammonia or amines, form metal salts with reactive metals or basically reacting metal compounds, and otherwise function as a conventional carboxylic acid acylating agents. Transesterification and transamidation reactions are considered, for purposes of this invention, as conventional acylating reaction.

Thus, X and/or X' is usually -OH, -O-hydrocarbyl, -O-M+ where M+ represents one equivalent of a metal, ammonium or amine cation, $-NH_2$, -Cl, -Br, and together, X and X' can be -O- so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both $$-\overset{O}{\overset{\|}{C}}-X \text{ and } -\overset{O}{\overset{\|}{C}}-X')$$

can enter into acylation reactions.

One of the unsatisfied valences in the grouping

-C-C- of Formula I forms a carbon-to-carbon bond with a carbon atom in the substituent group. While other such unsatisfied valence may be satisfied by a similar bond with the same or different substituent group, all but the said one such valence is usually satisfied by hydrogen; ie., -H.

The substituted succinic acylating agents are characterized by the presence within their structure of at least 1.3 succinic groups (that is, groups corresponding to Formula I) for each equivalent weight of substituent groups. For purposes of this invention, the number of equivalent weights of substituent groups is deemed to be the number corresponding to the quotient obtained by dividing the Mn value of the polyalkene from which the substituent is derived into the total weight of the substituent groups present in the substituted succinic acylating agents. Thus, if a substituted succinic acylating agent is characterized by a total weight of substituent group of 40,000 and the Mn value for the polyalkene from which the substituent groups are derived is 2000, then that substituted succinic acylating agent is characterized by a total of 20 (40,000/2000=20) equivalent weights of substituent groups. Therefore, that particular succinic acylating agent must also be characterized by the presence within its structure of at least 26 succinic groups to meet one of the requirements of the novel succinic acylating agents of this invention.

Another requirement for the substituted succinic acylating agents within this invention is that the substituent groups must have been derived from a polyalkene characterized by a Mw/Mn value of about 1.5 to about 4, Mw being the conventional symbol representing weight average molecular weight.

Before proceeding, it should be pointed out that the Mn and Mw values for polyalkene, for purposes of this invention, are determined by gel permeation chromatography (GPC). This separation method involves a column chromatography in which the stationary phase is a heteroporous, solvent-swollen polymer network of a polystyrene gel varying in permeability over many orders of magnitude. As the liquid phase (tetrahydrofuran) containing the polymer sample passes through the gel, the polymer molecules diffuse into all parts of the gel not mechanically barred to them. The smaller molecules "permeate" more completely and spend more time in the column; the larger molecules "permeate" less and pass through the column more rapidly. The Mn and Mw values of the polyalkenes of this invention can be obtained by one of ordinary skill in the art by the comparison of the distribution data obtained to a series of calibration standards of polymers of known molecular weight distribution. For purposes of this invention a series of fractionated polymers of isobutene, polyisobutene being the preferred embodiment, is used as the calibration standard.

For example, the Mw values disclosed herein are obtained using a Waters Associates model 200 gel permeation chromatograph equipped with a 2.5 ml syphon, a 2 ml sample injection loop and four stainless steel columns 7.8 mm in diameter by 120 centimeters long. Each column was packed with μ STYROGEL, a commercially available, rigid, porous gel (in particle form) of crosslinked styrene/divinyl benzene copolymers. These gels are also obtained from Waters Associates. The first column contains μ STYROGEL having a retention volume of $10^3$ A. The second and third columns contain STYROGEL having a retention size of 500 A. The fourth column contains STYROGEL having a retention volume of 60 A. The first column is connected to the sample loop with stainless steel tubing, 83.3 cm long. The first column is connected to the second with a 2.3 cm length of the stainless steel tubing. The second and third columns are each connected by 10.2 cm lengths of tubing. The fourth column is connected to the detector by a 25.4 cm length of tubing. All the connecting tubing is 1.6 mm in diameter.

Calibration standards were prepared by dialyzing a polyisobutylene sample having a specific gravity at 60° F. (15.5° C.) of 0.89 and a viscosity at 210° F. (99° C.) of 12.50 SUS. A sample of this polymer is fractionated by dialysis using a rubber membrane and a soxhlet extraction apparatus with refluxing petroleum ether as solvents. Eleven fractions were taken; one sample each hour for the first seven hours, then three samples each for four hours, and finally the residue which did not permeate the membrane over a four-hour period and the Mn of each was measured using vapor phase osmometry and benzene solvent.

Each calibration sample is then chromatographed. Approximately 7 mg of sample is weighed into a small bottle which is then filled with 4 ml of reagent grade tetrahydrofuran. The sealed bottle is stored overnight before analysis. The afore-described liquid phase chromatograph is degassed at 59° C. and a flow rate of 2.0 ml per minute of tetrahydrofuran maintained. Sample pressure is 180 psi and the reference pressure 175 psi. The retention time of each sample is measured. The Mw of each calibration sample is calculated from the Mn assuming the relationship 2 Mn=Mw. The retention times and Mw for each sample, which are shown in the following table, were plotted to provide a standardization curve. The Mn and Mw for sample polymers is then obtained using this curve and the methods described in "Topics in Chemical Instrumentation, Volume XXIX, Gel Permeation Chromatography" by Jack Cages, published in The Journal of Chemical Education, Volume 43, numbers 7 and 8, (1966).

Polyalkenes having the Mn and Mw values discussed above are known in the art and can be prepared according to conventional procedures. Several polyalkenes, especially polybutenes, are commercially available.

TABLE I

| | | |
|---|---|---|
| 30 42240 | 40 638 | 50 229 |
| 31 26400 | 41 539 | 51 216 |
| 32 16985 | 42 453 | 52 202 |
| 33 10780 | 43 400 | 53 189 |
| 34 6710 | 44 361 | 54 178 |
| 35 4180 | 45 330 | 55 167 |
| 36 2640 | 46 304 | 56 156 |
| 37 1756 | 47 282 | |
| 38 1200 | 48 264 | |
| 39 865 | 49 246 | |

*Rt = retention time in units of number of times syphan (2.5 ml) empties. The syphan empties every 2.5 min.

Again, turning to the characteristics of the succinic acylating agents of this invention, the succinic groups will normally correspond to the formula

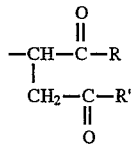

(II)

wherein R and R' are each independently selected from the group consisting of -OH, -Cl, -O-lower alkyl, and when taken together, R and R' are -O-. In the latter case, the succinic group is a succinic anhydride group. All the succinic groups in a particular succinic acylating agent need not be the same, but they can be the same. Preferably, the succinic groups will correspond to

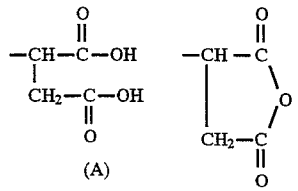

(III)

(A) (B)

and mixtures of III(A) and III(B). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.5. Preferably, however, the minimum will be 1.4; usually 1.4 to about 3.5 succinic groups for each equivalent weight of substituent group. A preferred range based on this minimum is at least 1.5 to about 2.5 succinic groups per equivalent weight of substituent groups.

From the foregoing, it is clear that the substituted succinic acylating agents of this invention can be represented by the symbol $$R_1(\leftarrow R_2)_y$$

wherein $R_1$ represents one equivalent weight of substituent group, $R_2$ represents one succinic group corresponding to Formula I, Formula II, or Formula III as discussed above, and y is a number equal to or greater than 1.3; ie., 24 1.3. The more preferred embodiments of the invention could be similarly represented by, for example, letting $R_1$ and $R_2$ represent more preferred substituent groups and succinic groups, respectively, as discussed elsewhere herein and by letting the value of y vary as discussed above; eg., y is equal to or greater than 1.4 ($y \geqq 1.4$; y is equal to or greater than 1.5 ($y \geqq 1.5$); y equals 1.4 to about 3.5 ($y \geqq 1.4$–3.5); and y equals 1.5 to about 3.5 ($y \geqq 1.5$–3.5).

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of Mn, for example, a minimum of about 1500 is preferred with an Mn value in the range of from about 1500 to about 3200 also being preferred. A more preferred Mn value is one in the range of from about 1500 to about 2800. A most preferred range of Mn values is from about 1500 to about 2400. With polybutenes, an especially preferred minimum value for Mn is about 1700 and especially preferred range of Mn values is from about 1700 to about 2400.

As to the values of the ratio Mw/Mn, there are also several preferred values. A minimum Mw/Mn value of about 1.8 is preferred with a range of values of about 1.8 up to about 3.6 also being preferred. A still more preferred minimum value of Mw/Mn is about 2.0 with a preferred range of values of from about 2.0 to about 3.4 also being a preferred range. An especially preferred minimum value of Mw/Mn is about 2.5 with a range of values of about 2.5 to about 3.2 also being especially preferred.

Before proceeding to a further discussion of the polyalkenes from which the substituent groups are derived, it should be pointed that these preferred characteristics of the succinic acylating agents are, for lack of better terminology to describe the situation contemplated by this invention, intended to be understood as being both independent and dependent. They are intended to be independent in the sense that, for example, a preference for a minimum of 1.4 or 1.5 succinic groups per equivalent weight of substituent groups is not tied to a more preferred value of Mn or Mw/Mn. They are intended to be dependent in the sense that, for example, when a preference for a minimum of 1.4 or 1.5 succinic groups is combined with more preferred values of Mn and/or Mw/Mn, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e.,>C=C<); that is, they are mono-olefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C=CH_2$. However, polymerizable internal olefin monomers (sometimes referred to in the patent literature as medial olefins) characterized by the presence within their structure of the group

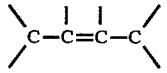

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

While the polyalkenes from which the substituent groups of the succinic acylating agents are derived generally are hydrocarbon polyalkenes, they can contain non-hydrocarbon polyalkenes, they can contain non-hydrocarbon groups such as lower alkoxy, lower alkyl mercapto, hydroxy, mercapto, oxo (i.e.,

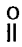

as in keto and aldehyde groups; e.g.

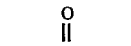

and

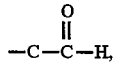

nitro, halo, cyano, carboalkoxy (i.e.,

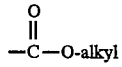

where "alkyl" is usually lower alkyl) alkanoyloxy (i.e., alkyl

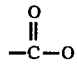

where alkyl is usually lower alkyl, and the like provided the non-hydrocarbon substituents do not substantially interfere with formation of the substituted succinic acid acylating agents of this invention. When present, such non-hydrocarbon groups normally will not contribute more than about 10% by weight of the total weight of the polyalkenes. Since the polyalkene can contain such non-hydrocarbon substituent, it is apparent that the olefin monomers from which the polyalkenes are made can also contain such substituents. Normally, however, as a matter of practicality and expense, the olefin monomers and the polyalkenes will be free from non-hydrocarbon groups, except chloro groups which usually facilitate the formation of the substituted succinic acylating agents of this invention. (As used herein, the term "lower" when used with a chemical group such as in "lower alkyl" or "lower alkoxy" is intended to describe groups having up to seven carbon atoms.)

Although the polyalkenes may include aromatic groups (especially phenyl groups and lower alkyl-and/or lower alkoxy-substituted phenyl groups such as para-(tert-butyl) phenyl) and cycloaliphatic groups such as would be obtained from polymerizable acyclic olefins, the polyalkenes usually will be free from such groups. Nevertheless, polyalkenes derived from interpolymers of both 1,3-doyennes and styrenes such as butadiene-1,3 and styrene or para-(tert-butyl) styrene are exceptions to this generalization. Again, because aromatic and cycloaliphatic groups can be present, the olefin monomers from which the polyalkenes are prepared can contain aromatic and cycloaliphatic groups.

From what has been described hereinabove in regard to the polyalkene, it is clear that there is a general preference for aliphatic, hydrocarbon polyalkenes free from aromatic and cycloaliphatic groups (other than the diene styrene interpolymer exception already noted). Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1; octene-1; nonene-1; decene-1; pentene-2; propylene-tetramer; diisobutylene; isobutylenetrimer; butadiene-1-2,; butadiene-1,3; pentadiene-1,2; pentadiene-1,3; pentadiene-1,4; isoprene; hexadiene-1,5; 2-chloro-butadiene-1,3; 2-methyl-heptene-1; 3-cyclohexylbutene-1; 2-methyl-5-propyl-hexene-1; pentene-3; octene-4; 3,3-dimethyl-pentene-1; styrene; 2,4-dichloro styrene; divinylbenzene; vinyl acetate; allyl alcohol; 1-methyl-vinylacetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-butadiene-1,3 copolymers, propene-isoprene copolymers, isobutene-(para-methyl) styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75 percent by weight and an isobutene content of about 30 to about 60 percent by weight in the presence of a Lewis acid catalyst such as aluminum trichloride or boron trifluoride. These polybutenes contain predominantly (greater than about 80% of the total repeating units) isobutene repeating units of the configuration

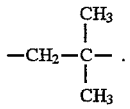

Obviously, preparing polyalkenes as described above which meet the various criteria for Mn and Mw/Mn is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes is reacted with one or more acidic reactants selected from the group consisting of maleic or fumaric reactants of the general formula

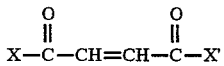

(IV)

wherein X and X' are as defined hereinbefore. Preferably the maleic and fumaric reactants will be one or more compounds corresponding to the formula

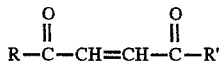

(V)

wherein R and R' are as previously defined herein. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents of the present invention. Basically, the procedures are analogous to procedures used to prepare the high molecular weight succinic anhydrides and other equivalent succinic acylating analogs thereof except that the polyalkenes (or polyolefins) of the prior art are replaced with the particular polyalkenes described above and the amount of maleic or fumaric reactant used must be such that there is at least 1.3 succinic groups for each equivalent weight of the substituent group in the final substituted succinic acylating agent produced.

For convenience and brevity, the term "maleic reactant" is often used hereafter. When used, it should be understood that the term is generic to acidic reactants selected from maleic and fumaric reactants corresponding to Formulas IV and V above including a mixture of such reactants.

One procedure for preparing the substituted succinic acylating agents of this invention is illustrated, in part, in U.S. Pat. No. 3,219,666 which is expressly incorporated herein by reference for its teachings in regard to preparing succinic acylating agents. This procedure is conveniently designated as the "two-step procedure." It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated and polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents of the invention utilizes a process described in U.S. Pat. No. 3,912,764 and U.K. Pat No. 1,440,219, both of which are expressly incorporated herein by reference for their teachings in regard to that process. According to that process, the polyalkene and the maleic reactant are first reacted by heating them together in a "direct alkylation"

procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer, ie., polyalkene. The direct alkylation step is conducted at temperatures of 180° C. to 250° C. During the chlorine-introducing stage, a temperature of 160° C. to 225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

Other processes which can be used to prepare the substituted succinic acylating agents of this invention are disclosed in the following commonly assigned copending U.S. patent applications:

(1) Ser. No. 582,062 entitled AN IMPROVED PROCESS FOR MAKING SUCCINIC ACID ACYLATING AGENTS filed May 29, 1975, in the name of Jerome Martin Cohen now abandoned.

(2) Ser. No. 695,234 ENTITLED TWO-STEP METHOD FOR THE PREPARATION OF SUBSTITUTED CARBOXYLIC ACIDS filed June 11, 1976, in the name of Jerome Martin Cohen now U.S. Pat. No. 4,110,349.

Both (1) and (2) are expressly incorporated herein by reference for their teachings in regard to these processes.

The processes presently deemed to be best for preparing the substituted succinic acylating agents of this invention from the standpoint of efficiency, overall economy, and the performance of the acylating agents thus produced, as well as the performance of the derivatives thereof, is the so-called "one-step" process. This process is described in U.S. Pat. Nos. 3,215,707 and 3,231,587. Both are expressly incorporated herein by reference for their teachings in regard to that process.

Basically, the one-step process involves preparing a mixture of the polyalkene and the maleic reactant containing the necessary amounts of both to provide the desired substituted succinic acylating agents of this invention. This means that there must be at least 1.3 moles of maleic reactant for each mole of polyalkene in order that there can be at least 1.3 succinic groups for each equivalent weight of substituent groups. Chlorine is then introduced into the mixture, usually by passing chlorine gas through the mixture with agitation, while maintaining a temperature of at least about 140° C.

A variation on this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and per-chlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. The preferred temperature range is usually between about 160° C. and about 220° C. Higher temperatures such as 250° C. or even higher may be used but usually with little advantage. In fact, temperatures in excess of 220° C. are often disadvantageous with respect to preparing the particular acylated succinic compositions of this invention because they tend to crack the polyalkenes (that is, reduce their molecular weight by thermal degradation) and/or decompose the maleic reactant. For this reason, maximum temperatures of about 200° to about 210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

As mentioned previously, the molar ratio of polyalkene to maleic reactant is such that there is at least about 1.3 moles of maleic reactant for each mole of polyalkene. This is necessary in order that there can be at least 1.3 succinic groups per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

A preferred process for preparing the substituted acylating compositions of this invention comprises heating and contacting at a temperature of at least about 140° C. up to the decomposition temperature (A) Polyalkene characterized by Mn value of about 1300 to about 5000 and a Mw/Mn value of about 1.5 to about 4, (B) One or more acidic reactants of the formula

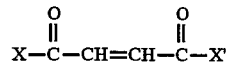

wherein X and X' are as defined hereinbefore, and (C) Chlorine wherein the mole ratio of (A):(B) is such that there is at least about 1.3 moles of (B) for each mole of (A) wherein the number of moles of (A) is the quotient of the total weight of (A) divided by the value of Mn and the amount of chlorine employed is such as to provide at least about 0.2 mole (preferably at least about 0.5 mole) of chlorine for each mole of (B) to be reacted with (A), said substituted acylating compositions being characterized by the presence within their structure of an average of at least 1.3 groups derived from (B) for each equivalent weight of the substituted acylated compositions as produced by such a process are, likewise, part of this invention.

As will be apparent, it is intended that the immediately preceding description of a preferred process be generic to both the process involving direct alkylation with subsequent chlorination as described in U.S. Pat. No. 3,912,764 and U.K. Pat. No. 1,440,219 and to the completely one-step process described in U.S. Pat. Nos. 3,215,707 and 3,321,587. Thus, said description does not require that the initial mixture of polyalkene and acidic reactant contain all of the acidic reactant ultimately to be incorporated into the substituted acylating composition to be prepared. In other words, all of the acidic reactant can be present initially or only part thereof with subsequent addition of acidic reactant during the course of the reaction. Likewise, a direct alkylation reaction can precede the introduction of chlorine. Normally, however, the original reaction mixture will contain the total amount of polyalkene and acidic reactant to be utilized. Furthermore, the amount of chlorine used will normally be such as to provide about one mole of chlorine for each unreacted mole of (B) present at the time chlorine introduction is commenced. Thus, if the mole ratio of (A):(B) is such that there is about 1.5 moles of (B) for each mole of (A) and if direct alkylation results in half of (B) being incorporated into the product, then the amount of chlorine introduced to complete reaction will be based on the unreacted 0.75 mole of (B); that is, at least about 0.75 mole of chlorine (or an excess as explained above) will then be introduced.

In a more preferred process for preparing the substituted acylating compositions of this invention, there is heated at a temperature of at least about 140° C. a mixture comprising:

(A) Polyalkene characterized by a Mn value of about 5000 and a Mw/Mn value of about 1.3 to about 4, (B) One or more acidic reactants of the formula

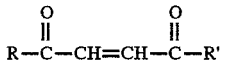

wherein R and R' are as defined above, and (C) Chlorine, wherein the mole ratio of (A):(B) is such that here is at least about 1.3 moles of (B) for each mole of (A) where the number of moles of (A) is a quotient of the total weight of (A) divided by the value of Mn, and the amount of chlorine employed is such as to provide at least about one mole of chlorine for each mole of (B) reacted with (A), the substituted acylating compositions being further characterized by the presence within their structure of at least 1.3 groups derived from (B) for each equivalent weight of the substituent groups derived from (A). This process, as described, includes only the one-step process; that is, a process where all of both (A) and (B) are present in the initial reaction mixture. The substituted acylated composition as produced by such a process are, likewise, part of this invention.

This is an appropriate point to comment upon the use of the terminology "substituted succinic acylating agent(s)" and "substituted acylating composition" as used herein. The former terminology is used in describing the substituted succinic acylating agents regardless of the process by which they are produced. Obviously, as discussed in more detail hereinbefore, several processes are available for producing the substituted succinic acylating agents. On the other hand, the latter terminology; that is, "substituted acylating composition(s)", is used to describe the reaction mixtures produced by the specific preferred processes described in detail herein. Thus, the identity of particular substituted acylating compositions is dependent upon a particular process of manufacture. It is believed that the novel acylating agents of this invention can best be described and claimed in the alternative manner inherent in the use of this terminology as thus explained. This is particularly true because, while the products of this invention are clearly substituted succinic acylating agents as defined and discussed above, their structure cannot be represented by a single specific chemical formula. In fact, mixtures of products are inherently present.

With respect to the preferred processes described above, preferences indicated hereinbefore with respect to (a) the substituted succinic acylating agents and (b) the values of Mn, the values of the ratio Mw/Mn, the identity and composition of the polyalkenes, the identity of the acidic reactant (that is, the maleic and/or fumaric reactants), the ratios of reactants, and the reaction temperature also apply. In like manner, the stone preferences apply to the substituted acylated compositions produced by these preferred processes.

For example, such processes wherein the reaction temperature is from about 160° C. to about 220° C. are preferred. Likewise, the use of polyalkenes wherein the polyalkene is a homopolymer or interpolymer of terminal olefins of 2 to about 16 carbon atoms, with the proviso that said interpolymers can optionally contain up to about 40% of the polymer units derived from internal olefins of up to about sixteen carbon atoms, constitutes the preferred aspect of the process and compositions prepared by the process. In a more preferred aspect, polyalkenes for use in the process and in preparing the compositions of the process are the homopolymers and interpolymers of terminal olefins of 2 to 6 carbon atoms with the proviso that said interpolymers can optionally contain up to about 25% of polymer units derived from internal olefins of up to about 6 carbon atoms. Especially preferred polyalkenes are polybutenes, ethylene-propylene copolymers, polypropylenes with the poly-butenes being particularly preferred.

In the same manner, the succinic group content of the substituted acylating compositions thus produced are preferably the same as that described in regard to the substituted succinic acylating agents. Thus, the substituted acylating compositions characterized by the presence within their structure of an average of at least 1.4 succinic groups derived from (B) for each equivalent weight of the substituent groups derived from (A) are preferred with those containing at least 1.4 up to about 3.5 succinic groups derived from (B) for each equivalent weight of substituent groups derived from (A) being still more preferred. In the same way, those substituted acylating compositions characterized by the presence within their structure of at least 1.5 succinic groups derived from (B) for each equivalent weight of substituent group derived from (A) are still further preferred, while those containing at least 1.5 succinic groups derived from (B) for each equivalent weight of substituent group derived from (A) being especially preferred.

Finally, as with the description of the substituted succinic acylating agents, the substituted acylating compositions produced by the preferred processes wherein the succinic groups derived from (B) correspond to the formulae

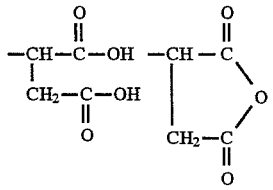

and mixtures of these constitute a preferred class.

An especially preferred process for preparing the substituted acylating compositions comprises heating at a temperature of about 160° C. to about 220° C. a mixture comprising:

(A) Polybutene characterized by a Mn value of about 1700 to about 2400 and a Mw/Mn value of about 2.5 to about 3.2, in which at least 50% of the total units derived from butenes is derived from isobutene, (B) One or more acidic reactants of the formula

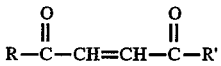

wherein R and R' are each -OH or when taken together, R and R' are -O-, and (C) Chlorine wherein the mole ratio of (A):(B) is such that there is at least 1.5 moles of (B) for each mole of (A) and the number of moles of (A) is the quotient of the total weight of (A) divided by the value of Mn, and the amount of chlorine employed is such as to provide at least about one mole of chlorine for each mole of (B) to be reacted with (A), said acylating compositions being characterized by the presence within their structure of an average of at lest 1.5 groups derived from (B) for each equivalent weight of the substituent groups derived from (A). In the same manner, substituted acylating compositions produced by such a process constitute a preferred class of such compositions.

The following examples illustrate preparation of the tackifier:

EXAMPLE C-1

A mixture of 510 parts (0.28 mole) of polyisobutene (Mn=1845; Mw=5325) and 59 parts (0.59 mole) of maleic anhydride is heated to 110° C. This mixture is heated to 190° C. in seven hours during which 43 parts (0.6 mole) of gaseous chlorine is added beneath the surface. At 190°–192° C. an additional 11 parts (0.16 mole) of chlorine is added over 3.5 hours. The reaction mixture is stripped by heating at 190°–193° C. with nitrogen blowing for 10 hours. The residue is the desired poly- isobutene-substituted succinic acylating agent having a saponification equivalent number of 87 as determined by ASTM procedure D-94.

EXAMPLE C-2

A mixture of 1,000 parts (0.495 mole) of polyisobutene (Mn=2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184° C. an additional 59 parts (0.83 mole) of chlorine is added over 4 hours. The reaction mixture is stripped by heating at 186°–190° C. with nitrogen blowing for 26 hours. The residue is the desired polyisobutene-substituted succinic acylating agent having a saponification equivalent number of 87 as determined by ASTM procedure D-94.

EXAMPLE C-3

A mixture of 3,251 parts of polyisobutene chloride, prepared by the addition of 251 parts of gaseous chlorine to 3,000 parts of polyisobutene (Mn=1696; Mw=6594) at 80° C. in 4.66 hours, and 345 parts of maleic anhydride is heated to 200° C in 0.5 hour. The reaction mixture is held at 200°–224° C. for 6.33 hours, stripped at 210° C. under vacuum and filtered. The filtrate is the desired polyisobutene-substituted succinic acylating agent having a saponification equivalent number of 94 as determined by ASTM procedure D-94.

EXAMPLE C-4

A mixture of 3,000 parts (1.63 moles) of polyisobutene (Mn=1845; Mw=5325) and 344 parts (3.51 moles) of maleic anhydride is heated to 140° C. This mixture is heated to 201° C. in 5.5 hours during which 312 parts (4.39 moles) of gaseous chlorine is added beneath the surface. The reaction mixture is heated at 201°–236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

EXAMPLE C-5

A mixture of 3,000 parts (1.49 moles) of polyisobutene (Mn=2020; Mw=6049) and 364 parts (3.71 moles) of maleic anhydride is heated at 220° C. for 8 hours. The reaction mixture is cooled to 170° C. At 170°–190° C., 105 parts (1.48 moles) of gaseous chlorine is added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

EXAMPLE C-6

A mixture of 800 parts of a polyisobutene falling within the scope of the claims of the present invention and having a Mn of about 2000, 646 parts of mineral oil and 87 parts of maleic anhydride is heated to 149° C. in 2.3 hours. At 176°–180° C. 100 parts of gaseous chlorine is added beneath the surface over a 19 hour period. The reaction mixture is stripped by blowing with nitrogen for 0.5 hour at 180° C. The residue is an oil-containing solution of the desired polyisobutene-substituted succinic acylating agent.

EXAMPLE C-7

The procedure for Example 1 is repeated except the polyisobutene (Mn=1845; Mw=5325) is replaced on an equimolar basis by polyisobutene (Mn=1457; Mw=5808).

EXAMPLE C-8

The procedure for Example 1 is repeated except the polyisobutene (Mn=1845; Mw=5325) is replaced on an equimolar basis by polyisobutene (Mn=2510; Mw=5793).

(D) The Pour Point Depressant

The pour point depressant (PPD) functions by acting as a nucleating agent which promotes the formation of small wax crystals; the PPD does not prevent wax crystal formation. Controlling the volume of the crystal is key in maintaining lubricant flow.

The PPD is similar to the viscosity modifying composition in all respects except that the carboxyl containing interpolymer has a reduced specific viscosity of from about 0.05 to about 1 and being characterized by the presence within its polymeric structure of at least one of each of the following groups which are derived from the carboxyl groups of said interpolymer:

(A') a carboxylic ester group, said carboxylic ester group having at least eight aliphatic carbon atoms in the ester radical, and (B') a carbonyl-polyamino group derived from a polyamino compound having one primary or secondary amino group and at least one mono-functional amino group, wherein the molar ration of carboxyl groups of said interpolymer esterified to provide (A') to carboxyl groups of said interpolymer neutralized to provide (B') is in the range of about 85:15 to about 99:1.

The (A') (C-2) is the same as the (A) of (C-1) and the (B') of (C-2) is the same as the (C) of (C- 1).

The following examples are illustrative of the preparation of (C-2) of the present invention. Unless otherwise indicated all parts and percentages are by weight.

EXAMPLE D-1

A styrene-maleic interpolymer is obtained by preparing a solution of styrene (536 parts) and maleic anhydride (505 parts) in toluene (7585 parts) and contacting the solution at a temperature of 99°–101 ° C. and an absolute pressure of 480–535 mm. Hg. with a catalyst solution prepared by dissolving benzoyl peroxide (2.13 parts) in toluene (51.6 parts). The catalyst solution is added over a period of 1.5 hours with the temperature maintained at 99°–101° C. Mineral oil (2496 parts) is added to the mixture. The mixture is maintained at 99°–101° C. and 480–535 mm Hg for 4 hours. The resulting product is a slurry of the interpolymer in the solvent mixture. The resulting interpolymer has a reduced specific viscosity of 0.42.

EXAMPLE D-2

A toluene slurry (2507 parts), having 11.06% solids and 88.94% volatiles, of the maleic anhydride/styrene interpolymer of Example D-1, Neodol 45 (632 parts), a product of Shell Chemical Company identified as a mixture of C14 and C15 liner primary alcohols, mineral oil (750 parts), and Ethyl Antioxidant 733 (4.2 parts), a product of Ethyl identified as an isomeric mixture of butyl phenols, are charged to a vessel. The mixture is heated with medium agitation under nitrogen purge at 0.5 standard cubic feet per hour until the temperature reaches 115° C. Seventy percent methane sulfonic acid catalyst in water (10.53 parts) is added dropwise over a period of 20 minutes. Nitrogen purge is increased to 1.0 standard cubic feet per hour and temperature is raised by removal of toluene-water distillate. The mixture is maintained at a temperature of 150° C. for five hours under a nitrogen purge of 0.1–0.2 standard cubic feet per hour. Additional methane sulfonic acid solution (15.80 parts) is added to the mixture over a period of 15 minutes. The mixture is maintained at 150° C. for 3.5 hours. The degree of esterification is 95.08%. Aminopropylmorpholine (35.2 parts) is added to the mixture dropwise over a period of 20 minutes. The mixture is maintained at 150° C. for an additional 30 minutes, then cooled with stirring. The mixture is stripped from 50° C. to 141° C. at a pressure of 102 mm. Hg then permitted to cool. At a temperature of 100° C., mineral oil (617 parts) is added. Cooling is continued to 60° C. At 60° C., diatomaceous earth (36 parts) is added and the mixture is heated to 100° C. The mixture is maintained at 100°–105° C. for one hour with stirring and then filtered to yield the desired product.

EXAMPLE D-3

The procedure of Example D-2 is repeated with the exception that both Neodol 45 (315.4 parts) and Alfol 1218 (312.5 parts), a product of Continental Oil Company identified as a mixture of synthetic primary straight chain alcohols having 12 to 18 carbon atoms, are initially charged, rather than the 631 parts of Neodol 45 which were included in the initial charge in Example D-2.

EXAMPLE D-4

A toluene slurry (1125 parts), having 13.46% solids and 86.54% volatiles, of the maleic anhydride/styrene interpolymer of Example D-1, mineral oil (250 parts) and Neodol 45 (344 parts) are charged to a vessel. The mixture is heated with medium agitation under nitrogen sweep of 0.5 standard cubic feet per hour until the temperature reaches 110° C. Paratoluene sulfonic acid (8.55 parts) in water (9 parts) is added dropwise over a period of 24 minutes. The temperature of the mixture is increased to 152° C. by removing toluene-water distillate. The temperature is maintained at 152°–156° C. under nitrogen sweep of 0.5 standard cubic feet per hour until the net acid number indicates that esterification is at least 95% complete. Aminopropylmorpholine (15.65 parts) is added dropwise over a period of 10 minutes. The temperature of the mixture is maintained at 155° C. for 1 hour and then cooled under a nitrogen sweep. Ethyl Antioxidant 733 (1.48 parts) is added to the mixture. The mixture is stripped at 143° C. and 99 mm. Hg pressure. The mixture is cooled under nitrogen sweep. Mineral oil is added to provide a total 63% dilution. Ethyl Antioxidant 733 (1.79 parts) is added and the mixture is stirred for 30 minutes. The mixture is heated to 60° C. while stirring with a nitrogen sweep of 0.5 standard cubic feet per hour. Diatomaceous earth (18 parts) is added to the mixture. The mixture is heated to 90° C. The temperature of the mixture is maintained at 90°–100° C. for 1 hour and then filtered through a pad of diatomaceous earth (18 parts) in a heated funnel to yield the desired product.

EXAMPLE D-5

The procedure of Example D-4 is repeated with the exception that both Neodol 45 (172 parts) and Alfol 1218 (169 parts) are provided in the initial charge, rather than the 344 parts of Neodol 45 provided in Example D-4.

EXAMPLE D-6

The product of Example D-1 (101 parts), Neodol 91 (56 parts) a product of Shell Chemical Company identified as a mixture of C9, C10, and C11 alcohols, TA-1618 (92 parts), a product of Procter & Gamble identified as a mixture of C16 and C18 alcohols, Neodol 25 (62 parts), a product Shell Chemical Company identified as a mixture of C12, C13, C14, and C15 alcohols, and toluene (437 parts) are charged to a vessel. The vessel is stirred and the contents are heated. Methane sulfonic acid (5 parts) is added to the mixture. The mixture is heated under reflux conditions for 30 hours. Aminopropylmorpholine (12.91 parts) is added to the mixture. The mixture is heated under reflux conditions for an additional 4 hours. Diatomaceous earth (30 parts) and a neutral paraffinic oil (302 parts) are added to the mixture which is then stripped. The residue is filtered to yield 497.4 parts of an orange-brown viscous liquid.

EXAMPLE D-7

The product of Example D-1 (202 parts), Neodol 91 (112 parts), TA 1618 (184 parts), Neodol 25 (124 parts and toluene (875 parts) are charged to a vessel. The mixture is heated and stirred. Methane sulfonic acid (10 parts) is added to the mixture which is then heated under reflux conditions for 31 hours. Aminopropylmorpholine (27.91 parts) is added to the mixture which is then heated under reflux conditions for an additional 5 hours. Diatomaceous earth (60 parts) is added to the mixture which is then stripped and 600 parts of polymer remain in the vessel. A neutral paraffinic oil (600 parts) is added to the mixture which is then homogenized. The mixture is filtered through a heated funnel to yield 1063 parts of a clear orange-brown viscous liquid.

EXAMPLE D-8

The product of Example D-1 (101 parts), Alfol 810 (50 parts), a product of Continental Oil Company identified as a mixture of C8 and C10 alcohols, TA-1618 (92 parts), Neodol 25 (62 parts) and toluene (437 parts) are charged to a vessel. The mixture is heated and stirred. Methane sulfonic acid (5 parts) is added to the mixture which is heated under reflux conditions for 30 hours. Aminopropylmorpholine (15.6 parts) is added to the mixture which is then heated under reflux conditions for an additional 5 hours. The mixture is stripped to yield 304 parts of a yellow-orange viscous liquid. Diatomaceous earth (30 parts) and a neutral paraffinic oil (304 parts) are added to the mixture which is then homogenized. The mixture is filtered through a heated funnel to yield 511 parts of a clear amber viscous liquid.

EXAMPLE D-9

A toluene slurry (799 parts) of a maleic anhydride/styrene interpolymer (17.82% polymer) is charged to a vessel. The reduced specific viscosity of the interpolymer is 0.69. The vessel is purged with nitrogen while stirring the contents for 15 minutes. Alfol 1218 (153 parts), Neodol 45 (156 parts) and 93% sulfuric acid (5 parts) are added to the mixture. Toluene (125 parts) is then added to the mixture. The mixture is heated at 150°–156° C. for 18 hours. Aminopropylmorpholine (1.3 parts) is added to the mixture which is then heated for an additional 1 hour at 150° C. The mixture is cooled to 80° C. Ethyl Antioxidant 733 (1.84 parts) is added to the mixture. The mixture is stripped at 143° C. and 100 mm. Hg. Mineral oil (302 parts) and Ethyl Antioxidant 733 (2.5 parts) is added to the mixture while the mixture is stirred. Diatomaceous earth (25 parts) is added to the mixture. The temperature of the mixture is maintained at 70° C. for 45 minutes and then heated to 110° C. Diatomaceous earth (25 parts) is added to the mixture. The mixture is filtered through diatomaceous earth to yield the desired product.

EXAMPLE D-10

A toluene and mineral oil slurry (699 parts) containing 17.28% solids of a maleic anhydride/styrene interpolymer (reduced specific viscosity of 0.69), Neodol 45 (139 parts), Alfol 1218 (138 parts), Ethyl Antioxidant 733 (2.9 parts) and toluene (50 parts are charged to a vessel. The mixture is heated under a nitrogen purge at 0.5 standard cubic feet per hour. 70% methane sulfonic acid (3.9 parts) is added dropwise over a period of 9 minutes. The mixture is heated under reflux conditions for 35 minutes. Toluene (51 parts) is added to the mixture which is then heated for an additional 3 hours 15 minutes under reflux conditions. 70% methane sulfonic acid (3 parts) is added dropwise over a period of 3 minutes. The mixture is heated under reflux conditions for 3 hours 15 minutes. 70% methane sulfonic acid (3.9 parts) is added dropwise over a period of 12 minutes. The mixture is heated at 150°–152° C. for 3 hours 45 minutes. Aminopropylmorpholine (14.3 parts) is added to the mixture dropwise over a period of 15 minutes. The mixture is maintained at a temperature of 149°–150° C. for an additional 30 minutes. The mixture is stripped at 140° C. and 100 mm. Hg. The mixture is cooled to 50° C. Mineral oil (338 parts) and diatomaceous earth (19 parts) are added to the mixture. The temperature of the mixture is maintained at 100°–105° C. for 1.5 hours and then filtered through additional diatomaceous earth (18 parts) to yield the desired product.

(E) The Antiwear Agent

The antiwear agent provides a sacrificial film on the metal surface. This film is then removed during asperity contact thereby reducing the removal of metal from the surface.

In one aspect the antiwear agent is a sulfurized composition (E-1). Useful sulfurized compositions for use in connection with the present invention are prepared by reacting, at about 100°–250° C., sulfur with a mixture comprising (A) 100 parts by weight of at least one fatty acid ester, (B) about 0–50 parts by weight of at least one fatty acid, and (C) about 25–400 parts by weight of at least one aliphatic olefin containing about 8–36 carbon atoms.

Reagent A is at least one fatty acid ester. The term "fatty acid" as used herein refers to acids which may be obtained by hydrolysis of a naturally occurring vegetable or animal fat or oil. These are usually in the $C_{16-20}$ range and include palmitic acid, stearic acid oleic acid, linoleic acid and the like.

Fatty acid esters which are useful as reagent A are primarily those with aliphatic alcohols, including monohydric alcohols such as methanol, ethanol, n-propanol, isopropanol, the butanols, etc., and polyhydric alcohols including ethylene glycol, propylene glycol, trimethylene glycol, neopentyl glycol, glycerol and the like. Particularly preferred are the fatty oils, that is, naturally occurring esters of glycerol with the above noted long chain carboxylic acids, and synthetic esters of similar structure. Still more preferred are fatty oils derived from unsaturated acids, especially oleic and linoleic, including such naturally occurring animal and vegetable oils as lard oil, peanut oil, cottonseed oil, soybean oil, corn oil, sunflower oil and the like.

Reagent B is at least one fatty acid as described above. It is usually an unsaturated fatty acid such as oleic or linoleic acid, and may be a mixture of acids such as is obtained from tall oil or by the hydrolysis of peanut oil, soybean oil or the like. The amount of reagent B is about 0–50 parts by weight per 100 parts of reagent A; that is, it is an optional ingredient. However, it improves the slip, rust inhibiting and extreme pressure properties of lubricants containing the sulfurized compositions of this invention, and so its presence (generally in the amount of about 2–8 parts by weight is preferred.

Reagent C is at least one $C_{8-36}$ aliphatic olefin. About 25–400 parts, usually about 25–75 parts, of reagent C are present per 100 parts of reagent A. Terminal olefins, or alpha-olefins, are preferred, especially those in $C_{12-20}$ range. Mixtures of these olefins are commercially available and such mixtures are contemplated for use in this invention.

In addition to the above-described reagents, the reaction mixture may contain other materials. These may include, for example, sulfurization promoters, typically phosphorous-containing reagents such as phosphorous acid esters (e.g., triphenyl phosphite), and surface active agents such as lecithin.

The sulfurization occurs at a temperature of about 100°–250° C., usually about 150°–210° C. The weight ratio of the combination of reagents A, B and C to sulfur is between about 5:1 and 15:1, generally between about 5:1 and 10:1.

The sulfurization reaction is effected by merely heating the reagents at the temperature indicated above, usually with efficient agitation and in an inert atmosphere (e.g., nitrogen). If any of the reagents, especially reagent C, are appreciably volatile at the reaction temperature, the reaction vessel may be sealed and maintained under pressure. It is frequently advantageous to add the sulfur portionwise to the mixture of the other reagents. While it is usually preferred that the reaction mixture consist entirely of the reagents previously described, the reaction may also be effected in the presence of an inert solvent (e.g., an alcohol, ether, ester, aliphatic hydrocarbon, halogenated aromatic hydrocarbon or the like) which is liquid within the temperature range employed. When the reaction temperature is relatively high, e.g., about 200° C., there may be some evolution of sulfur from the product which is avoided if a lower reaction temperature (e.g., about 150°–170° C.) is used. However, the reaction sometimes requires a longer time at lower temperatures and an adequate sulfur content is usually obtained when the temperature is at the high end of the recited range.

Following the reaction, insoluble by-products may be removed by filtration, usually at an elevated temperature (about 80°–120° C.). The filtrate is the desired sulfurized product.

In general, products prepared as described above and containing about 8–13% (by weight) sulfur are preferred for the purposes of this invention.

The following examples illustrate the preparation of the sulfurized composition.

EXAMPLE (E-1)-1

To a mixture of 100 parts soybean oil, 5.4 parts of tall oil acid and 45.3 parts of a $C_{16-18}$ alpha olefin at 136° C. under nitrogen is added over 30 minutes, with stirring 17.7 parts of sulfur. An exothermic reaction occurs which causes the temperature to rise to 185° C. The contents are heated to 160° C.–175° C. for 3 hours, cooled to 90° C. and filtered to yield the desired product which contains 10.0% sulfur.

EXAMPLE (E-1)-2

A mixture of 60 parts of commercial $C_{15-20}$ alpha-olefins and 100 parts of lard oil is heated to 160° C., under nitrogen, and 12 parts of sulfur is added. The mixture is heated at 65°–200° C. and an additional 6.5 parts of sulfur is added. Heating is continued for 4 hours, after which the mixture is cooled to 100° C. and filtered to yield the desired product which contains 9.0% sulfur.

EXAMPLE (E-1)-3

To a mixture of 100 parts of soybean oil and 50 parts of 1 -hexadecene at 165° C., under nitrogen, is added over 20 minutes, with stirring, 20.6 parts of sulfur. An exothermic reaction occurs which causes the temperature to rise to 200° C. It is heated at 175°–200° C. for 6 hours, cooled to 110° C. and filtered to yield the desired product which contains 11.1% sulfur.

EXAMPLE (E-1)-4

A mixture of 100 parts of soybean oil and 50 parts of commercial $C_{16}$ alpha-olefins is heated to 175° C. under nitrogen and 17.4 parts of sulfur is added gradually, whereupon an exothermic reaction causes the temperature to rise to 205° C. The mixture is heated at 188°–220° C. for 5 hours, allowed to cool gradually to 90° C. and filtered to yield the desired product containing 10.13% sulfur.

EXAMPLE (E-1)-5

Following the procedure of Example (E-1)4, a sulfurized product is prepared from 100 parts of soybean oil, 50 parts of commercial $C_{15-18}$ alpha-olefins and 17.4 parts of sulfur. It contains 10.1% sulfur.

EXAMPLE (E-1)-6

Following the procedure of Example (E-1)-4, a product containing 10.13% sulfur is obtained by the reaction of 100 parts of soybean oil, 50 parts of commercial $C_{15-20}$ alpha-olefins and 17.9 parts of sulfur.

EXAMPLE (E-1)-7

Following the procedure of Example (E-1)-4, a product containing 9.69% sulfur is obtained from 100 parts of soybean oil, 100 parts of commercial $C_{22-24}$ alpha-olefins and 23.2 parts of sulfur.

EXAMPLE (E-1)-8

Following the procedure of Example (E-1)-4, a product containing 10.16% sulfur is obtained from 100 parts of cottonseed oil, 33.3 parts of commercial $C_{15-20}$ alpha-olefins and 15.6 parts of sulfur.

EXAMPLE (E-1)-9

Following the procedure of Example (E-1)-4, a product containing 8.81% sulfur is obtained from 100 parts of a triglyceride having an iodine number of 85–95, 25 parts of commercial $C_{15-18}$ alpha-olefins and 14.5 parts of sulfur.

EXAMPLE (E-1)-10

A mixture of 100 parts of soybean oil, 3.7 parts of tall oil acid and 46.3 parts of commercial $C_{15-18}$ alpha-olefins is heated to 165° C. under nitrogen, and 17.4 parts of sulfur is added. The temperature of the mixture rises to 191° C. It is maintained at 165°–200° C. for 7 hours and is then cooled to 90° C. and filtered. The product contains 10.13% sulfur.

EXAMPLE (E-1)-11

Following the procedure of Example (E-1)-10, a product containing 10.39% sulfur is obtained from 100 parts of soybean oil, 4 parts of tall oil acid, 46.3 parts of commercial $C_{15-18}$ alpha-olefins and 20.6 parts of sulfur.

EXAMPLE (E-1)-12

Following the procedure of Example (E-1)-10, a product containing 10.16% sulfur is obtained from 100 parts of soybean oil, 5.25 parts of tall oil acid, 44.4 parts of commercial $C_{15-18}$ alpha-olefins and 17.4 parts of sulfur.

EXAMPLE (E-1)-13

Following the procedure of Example (E-1)-10, a product containing 10.40% sulfur is obtained from 100 parts of peanut oil, 5.26 parts of tall oil acid, 45 parts of commercial $C_{15-18}$ alpha-olefins and 17.5 parts of sulfur.

EXAMPLE (E-1)-14

Following the procedure of Example (E-1)-10, a product containing 12.41% sulfur is obtained from 100 parts of soybean oil, 5.35 parts of tall oil acid, 46.3 parts of commercial $C_{15-18}$ alpha-olefins and 26.8 parts of sulfur.

In an even further aspect, Component (E) as (E-2) is a composition combining the mixture of from about 85–98, preferably 93–98 parts by weight of a salt of the formula

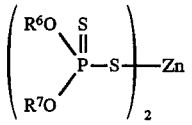

wherein $R^6$ and $R^7$ are independently substantially hydrocarbyl groups containing from about 3 to about 20 carbon atoms, with from about 2–15, preferably 2–7 parts by weight of an anhydride of the formula

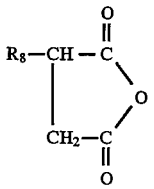

that has been reacted with water and an alkylene oxide wherein $R^8$ is a substantially saturated hydrocarbyl group containing from about 4 to about 50 carbon atoms.

The substantially saturated $R^6$ and $R^7$ radicals preferably contain from about 3 to about 10 carbon atoms and may be alkyl and alkylphenyl groups. Illustrative alkyl radicals include isopropyl, isobutyl, n-butyl, sec-butyl, the isomeric amyl radicals, the isomeric hexyl radicals, the isomeric heptyl radicals and the isomeric octyl radicals. A preferred alkyl radical is

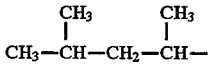

Illustrative alkylphenyl radicals include butylphenyl, amylphenyl, diamylphenyl, octyl-phenyl, etc. Other substantially hydrocarbon radicals are useful such as tetradecyl, octadecyl, eicosyl, butylnaphthyl, hexylnaphthyl, octylnaphthyl, naphthenyl, etc.

The preparation of the zinc salt is known in the art. Specifically it is prepared by the reaction of phosphorus pentasulfide with an alcohol or phenol. The reaction involves four moles of the alcohol or phenol per mole of phosphorus pentasulfide, and may be carded out within the temperature range from about 50° C. to about 200° C. Thus the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is an acid. The preparation of the zinc salt of this acid may be effected by reaction with zinc oxide. Simply mixing and heating two moles of the phosphorodithioic acid and one mole of zinc oxide is sufficient to cause the reaction to take place and the resulting product is sufficiently pure for the purposes of this invention.

Especially useful zinc phosphorodithioates can be prepared from phosphorodithioic acids which in turn are prepared by the reaction of phosphorus pentasulfide with mixtures of alcohols. The use of such mixtures enables the utilization of cheaper alcohols which in themselves do not yield oil-soluble phosphorodithioic acids. Thus a mixture of isopropyl and hexyl alcohols can be used to produce a very effective, oil-soluble zinc-phosphorodithioate.

$R^8$ of the anhydride is illustrated by the isomeric butyls, isomeric pentyls, isomeric hexyls, isomeric heptyls, isomeric octyls, isomeric nonyls, isomeric decyls, etc. The preparation of this anhydride is known in the art and involves reacting maleic anhydride with an olefin polymer or a chlorinated substantially saturated hydrocarbon. Preferably the anhydride is prepared by reacting polypropylene tetramer with maleic anhydride.

The anhydride is reacted with water and an alkylene oxide comprising ethylene oxide, propylene oxide, 1,2-butene oxide, trimethylene oxide, tetramethylene oxide, butadiene mono epoxide and 1,2-hexene oxide. Preferred is propylene oxide. For every 1000 parts anhydride about 50–80 parts alkylene oxide and 90–120 parts water is employed.

The following example outlines the preparation of Component (E-2).

EXAMPLE (E-2)-1

Charged to a 1-liter 4 necked flask is 300 parts of a propylene tetramer succinic acid anhydride. With stirring, the contents are heated to 60° C. and 34 parts water and 18 parts propylene oxide is added below the surface over 30 minutes.

In a 3 liter flask is added 1000 parts of a zinc salt of a methylamylphosphorodithioate and 64 parts mineral oil. With stirring, the contents are heated to 75° C. and 51 parts of the substituted succinic acid anhydride-water-propylene oxide reaction product are added over 30 minutes. The liquid is the product having the following analyses: % zinc 8.30, % sulfur 15.8, % phosphorus 7.62.

The composition of the present invention comprising components (A), (B), (C); (A), (B), (C) and (D); (A), (B), (C) and (E); or (A), (B), (C), (D) and (E) is useful as a chain bar lubricant. The following states the ranges of components (A), (B), (C), (D) and (E) in parts by weight.

| Component | Generally | Preferred | Most Preferred |
|---|---|---|---|
| (A) | 60-90 | 65-90 | 65-85 |
| (B) | 1-12 | 6-12 | 8-12 |
| (C) | 1-8 | 2-8 | 3-8 |
| (D) | 0-5 | 0-3 | 0-2 |
| (E) | 0-5 | 0-3 | 0-2 |

It is understood that other components besides (A), (B), (C), (D) and (E) may be present within this chain bar lubricant.

The components of this invention are blended together according to the above ranges to effect solution. The below Table II outlines examples so as to provide those of ordinary skill in the art with a complete disclosure and description on how to make the chain bar lubricant of this invention and it is not intended to limit the scope of what the inventor regards as his invention. All parts are by weight.

What is claimed is:

1. A lubricant composition, comprising:

(A) from about 60–90 % by weight of at least one naturally occurring triglyceride wherein the naturally occurring triglyceride is an ester of at least one straight chain fatty acid and glycerol wherein the fatty acid contains from about 8 to 22 carbon atoms and wherein the triglyceride is at least 60 percent monounsaturated and further wherein an oleic acid moiety:linoleic acid moiety ratio is from about 2 up to about 90; wherein the triglyceride is provided by high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm oil, (B) from about 1–12% by weight of at least one viscosity modifying additive, and (C) from about 1–8 % by weight of at least one tackifier comprising a substituted succinic acylating agent wherein said substituted succinic acylating agent consists of substituent groups and succinic groups wherein the substituent groups are derived from a polyalkene, said polyalkene being characterized by a Mn value of 1300 to about 5000 and a Mw/Mn value of about 1.5 to about 4, said acylating agents being characterized by the presence within their structure of an average of at least 1.3 succinic groups for each equivalent weight of substituent groups.

2. The composition of claim 1 further comprising (D) from about 0–5% by weight of at least one pour point depressant.

3. The composition of claim 1 further comprising (E) from about 0–5% by weight of at least one antiwear agent.

4. The composition of claim 1 wherein the fatty acid of the triglyceride contains from about 12 to about 22 carbon atoms.

5. The composition of claim 1 wherein the triglyceride is at least 70 percent monounsaturated.

6. The composition of claim 1 wherein the monounsaturated fatty acid is oleic acid.

7. The composition of claim 1 wherein the viscosity modifying additive is a nitrogen-containing mixed ester characterized by low-temperature viscosity modifying properties of a carboxyl-containing interpolymer, said interpolymer having a reduced specific viscosity of from about 0.05 to about 2 and being derived from at least two monomers, one of said monomers being a low molecular weight aliphatic olefin or styrene and the other of said monomers being an alpha, beta-unsaturated aliphatic acid, anhydride or ester thereof, said nitrogen-containing ester being substantially free of titratable acidity and being characterized by the presence within its polymeric structure of at least one of each of three pendant polar groups which are derived from the carboxyl groups of said nitrogen containing ester:

(A) a carboxylic ester group having at least 8 aliphatic carbon atoms in the ester radical, (B) a carboxylic ester group having no more than 7 aliphatic carbon atoms in the ester radical, (C) a carbonyl-polyamino group derived from a polyamino compound having one primary or secondary amino group, wherein the molar ratio of(A):(B):(C) is (60–90):(10–30):(2–15).

8. The composition of claim 7 wherein said nitrogen containing mixed ester is characterized by low-temperature viscosity modifying properties of a carboxyl-containing interpolymer, said interpolymer having a reduced specific viscosity of from about 0.05 to about 2 and being derived from at least two monomers, the one being ethylene, propylene, isobutene or styrene and the other being maleic acid or anhydride, itaconic acid or anhydride or acrylic acid or ester, said nitrogen-containing ester being substantially free of titratable acidity and being characterized by the presence within its polymeric structure of at least one of each of three pendant polar groups which are derived from the carboxyl groups of said nitrogen containing ester:

(A) a carboxylic ester group having at least 8 aliphatic carbon atoms in the ester radical, (B) a carboxylic ester group having no more than 7 aliphatic carbon atoms in the ester radical, (C) a carbonyl-polyamino group derived from a polyamino compound having one primary or secondary amino radical, wherein the molar ratio of(A):(B):(C) is (60–90):(10–30):(2–15).

9. The composition of claim 7 wherein the molar ratio of (A):(B):(C) is (70–80):(15–25):(5).

10. The composition of claim 7 wherein the interpolymer is a styrene-maleic anhydride interpolymer having a reduced specific viscosity of from about 0.3 to about 1.

11. The composition of claim 7 wherein the carboxylic ester group of (A) has from 8 to 24 aliphatic carbon atoms, the carboxylic ester group of (B) has from 3 to 5 carbon atoms and the carbonyl-polyamino group of (C) is derived from a primary-aminoalkyl-substituted tertiary amine.

12. The composition of claim 7 wherein the carboxyl-containing interpolymer is a terpolymer of one molar proportion of styrene, one molar proportion of maleic anhydride, and less that about 0.3 molar proportion of a vinyl monomer.

13. The composition of claim 7 wherein said low molecular weight aliphatic olefin of said nitrogen-containing ester is selected from the group consisting of ethylene, propylene or isobutene.

14. The composition of claim 1 wherein the viscosity modifying additive is an acrylate polymer of the formula

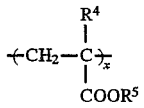

wherein $R^4$ is a lower alkyl group containing from 1 to about 4 carbon atoms, $R^5$ is a mixture of alkyl groups containing from about 4 to about 20 carbon atoms, and x is an integer providing a weight average molecular weight (Mw) to the acrylate polymer of about 5000 to about 1,000,000.

15. The composition of claim 14 wherein $R^4$ is a methyl group.

16. The composition of claim 14 wherein the molecular weight of the polymer is from about 100,000 to about 700,000.

17. The composition of claim 14 wherein $R^5$ is a mixture of alkyl groups containing from about 4 to about 18 carbon atoms.

18. The composition of claim 1 wherein the succinic groups of the tackifier correspond to the formula

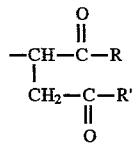

(II)

wherein R and R' are each independently selected from the group consisting of -OH, -Cl, -O-lower alkyl and, when taken together, R and $R^1$ are -O-, with the proviso that all the succinic groups need not be the same.

19. The composition of claim 18 wherein the substituent groups are derived from one or more polyalkene selected from the group consisting of homopolymers and interpolymers of terminal olefins of two to about sixteen carbon atoms, with the proviso that said interpolymers can optionally contain up to about 40% of polymer units derived from internal olefins of up to about sixteen carbon atoms.

20. The composition of claim 19 wherein said value of Mn is at least about 1500.

21. The composition of claim 20 wherein said value of Mw/Mn is at least about 1.8.

22. The composition of claim 21 wherein the substituent groups are derived from one or more polyalkene selected from the group consisting of homopolymers and interpolymers of terminal olefins of two to about six carbon atoms, with the proviso that said interpolymers can optionally contain up to about 25% of polymer units derived from internal olefins of up to about six carbon atoms.

23. The composition of claim 22 wherein the substituent groups are derived from a member selected from the group consisting of polybutene, ethylene-propylene copolymer, polypropylene, and mixtures of two or more of any of these.

24. The composition of claim 23 wherein the acylating agents are characterized by the presence within their structure of an average of at least 1.4 succinic groups for each equivalent weight of the substituent groups.

25. The composition of claim 24 wherein the value of Mn is about 1500 to about 2800.

26. The composition of claim 25 wherein the value of Mw/Mn is about 2.0 to about 3.4.

27. The composition of claim 26 wherein the acylating agents are characterized by the presence within their structure of at least 1.5 up to about 2.5 succinic groups for each equivalent weight of the substituent groups.

28. The composition of claim 27 wherein the substituent groups are derived from polybutene in which at least about 50% of the total units derived from butenes is derived from isobutene.

29. The composition of claim 28 wherein the succinic groups correspond to the formulae

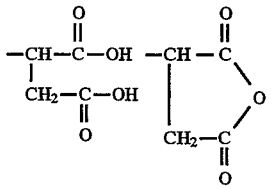

or mixtures of these.

30. The composition of claim 1 wherein the tackifier is a substituted 2 acylating composition prepared by heating at a temperature of at least about 140° C.:

(A) Polyalkene characterized by a Mn value of 1300 to about 5000 and a Mw/Mn value of about 1.5 to about 4, (B) One or more acidic reactants of the formula

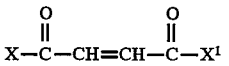

wherein X and $X^1$ are the stone or different provided at least one of X and $X^1$ is such that the substituted acylating composition can function as a carboxylic acylating agent, (C) Chlorine wherein the mole ratio of (A):(B) is such that there is at least 1.3 moles of (B) for each mole of (A) where the number of moles of (A) is the quotient of the total weight of (A) divided by the value of Mn, and the amount of chlorine employed is such as to provide at least about 0.2 mole of chlorine for each mole of (B) to be reacted with (A), said substituted acylating composition being characterized by at least 1.3 groups derived from (B) for each equivalent weight of the substituent groups derived from (A).

31. The composition of claim 30 wherein the amount of chlorine employed is such as to provide at least about one mole of chlorine for each mole of (B) to be reacted with (A).

32. The composition of claim 31 wherein the temperature is from about 160° C. to about 220° C.

33. The composition of claim 32 wherein (A) is one or more polyalkenes selected from the group consisting of homopolymers and interpolymers of terminal olefins of two to about sixteen carbon atoms with the proviso that said interpolymers can optionally contain up to about 40% of polymer units derived from internal olefins of up to about sixteen carbon atoms.

34. The composition of claim 33 wherein said value of Mn is at least about 1500.

35. The composition of claim 34 wherein said value of Mw/Mn is at least about 1.8.

36. The composition of claim 35 wherein (A) is one or more polyalkenes selected from the group consisting of homopolymers and interpolymers of terminal olefins of two to about six carbon atoms with the proviso that said interpolymers can optionally contain up to about 25% of polymer units derived from internal olefins of up to about six carbon atoms.

37. The composition of claim 36 wherein (A) is selected from the group consisting of polybutene, ethylene-propylene copolymer, polypropylene, and mixtures of two or more of any of these.

38. The composition of claim 37 wherein the acylating agents are characterized by the presence within their structure of an average of at least 1.4 succinic groups derived from (B) for each equivalent weight of the substituent groups derived form (A).

39. The composition of claim 38 wherein the value of Mn is about 1500 to about 2800.

40. The composition of claim 39 wherein the value of Mw/Mn is about 2.0 to about 3.4.

41. The composition of claim 40 characterized by the presence within their structure of at least 1.5 succinic groups up to about 2.5 succinic groups for each equivalent weight of the substituent groups derived from (A).

42. The composition of claim 41 wherein (A) is polybutene in which at least about 50% of the total units derived from butenes is derived from isobutene.

43. The composition of claim 42 wherein the groups derived from (B) correspond to the formulae

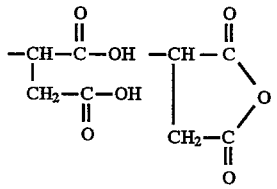

and mixtures of these.

44. The composition of claim 30 wherein said one or more substituted acylating compositions are prepared by heating at a temperature of about 160° C. to about 220° C. a mixture comprising:

(A) Polybutene characterized by a Mn value of about 1700 to about 2400 and a Mw/Mn value of about 2.5 to about 3.2, in which at least 50% of the total units derived from butenes is derived from isobutene, (B) One or more acidic reactants of the formula

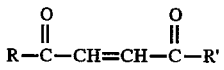

wherein R and R' are each independently selected from the group consisting of-OH and, when taken together, R and R' are -O-, and (C) Chlorine wherein the mole ratio of (A):(B) is such that there is at least 1.5 moles of (B) for each mole of (A) and the number of moles of (A) divided by the value of Mn, and the amount of chlorine employed is such as to provide at least about one mole of chlorine for each mole of (B) to be reacted with (A), said acylating compositions being characterized by the presence within their structure of an average of at least 1.5 groups derived from (B) for each equivalent weight of the substituent groups derived from (A).

45. The composition of claim 2 wherein the pour point depressant is a nitrogen-containing ester of a carboxyl-containing interpolymer, said interpolymer having a reduced specific viscosity of from about 0.05 to about 1 and being derived from at least two monomers, one of said monomers being a low molecular weight aliphatic olefin or styrene and the other of said monomers being an alpha, beta-unsaturated aliphatic acid, anhydride or ester thereof, said nitrogen-containing ester being substantially free of titratable acidity and being characterized by the presence within its polymeric structure of each of the following groups which are derived from the carboxyl groups of said interpolymer:

(A') a carboxylic ester group, said carboxylic ester group having at least eight aliphatic carbon atoms in the ester radical, and (B') a carbonyl-polyamino group derived from a polyamino compound having one primary or secondary amino group and at least one monofunctional amino group, wherein the molar ratio of carboxyl groups of said interpolymer esterified to provide (A') to carboxyl groups of said interpolymer neutralized to provide (B') is in the range of about 85:15 to about 99:1.

46. The composition of claim 45 wherein said reduced specific viscosity of said nitrogen-containing ester is in the range of about 0.3 to about 1.0.

47. The composition of claim 45 wherein said low molecular weight aliphatic olefin of said nitrogen-containing ester is selected from the group consisting of ethylene, propylene or isobutene.

48. The composition of claim 45 wherein said alpha, beta-unsaturated aliphatic acid, anhydride or ester of said nitrogen-containing ester is selected from the group consisting of maleic acid or anhydride, itaconic acid or anhydride, or acrylic acid or ester.

49. The composition of claim 45 wherein each of the ester radicals of (A') of said nitrogen-containing ester have from 8 to 24 carbon atoms and the carbonyl-polyamino group (B') is derived from a primary aminoalkyl-substituted tertiary amine.

50. The composition of claim 45 wherein the molar ratio of carboxyl groups of said interpolymer of said nitrogen-containing ester esterified to provide (A') to carboxyl groups neutralized to provide (B') is about 95:5.

51. The composition of claim 45 wherein said interpolymer of said nitrogen-containing ester is a terpolymer of one molar proportion of styrene, one molar proportion of maleic anhydride, and less than about 0.3 molar proportion of a vinyl monomer.

52. The composition of claim 45 wherein said polyamino compound of said nitrogen-containing ester is aminopropyl morpholine.

53. The composition of claim 3 wherein the antiwear agent is a sulfurized composition prepared by reacting, at about 100°–250° C., sulfur with a mixture comprising (A) 100 parts by weight of at least one fatty acid ester of a polyhydric alcohol, (B) about 2–50 parts by weight of at least one fatty acid, and (C) about 25–400 parts by weight of at least one aliphatic alpha-olefin containing about 8–36 carbon atoms.

54. The composition of claim 53 wherein reagent A is at least one fatty oil.

55. The composition of claim 54 wherein reagent C is at least one $C_{12-20}$ alpha-olefin.

56. The composition of claim 55 wherein reagent B is tall oil acid and is present in the amount of about 2–8 parts by weight.

57. The composition of claim 55 wherein reagent A is soybean oil.

58. The composition of claim 57 wherein reagent B is tall oil acid and is present in the amount of about 2–8 parts by weight.

59. The composition of claim 58 wherein reagent C is present in the amount of about 25–75 parts by weight.

* * * * *